US007896013B2

(12) United States Patent
Lerner

(10) Patent No.: US 7,896,013 B2
(45) Date of Patent: Mar. 1, 2011

(54) STICK AND HANDLE COMPONENT

(76) Inventor: Bo Lerner, Skellefteå (SE)

( * ) Notice: Subject to any disclaimer, the term of this patent is extended or adjusted under 35 U.S.C. 154(b) by 35 days.

(21) Appl. No.: 12/309,223

(22) PCT Filed: Jul. 4, 2007

(86) PCT No.: PCT/SE2007/000657

§ 371 (c)(1),
(2), (4) Date: Jan. 12, 2009

(87) PCT Pub. No.: WO2008/008017

PCT Pub. Date: Jan. 17, 2008

(65) Prior Publication Data

US 2009/0235967 A1 Sep. 24, 2009

(30) Foreign Application Priority Data

Jul. 13, 2006 (SE) ..... 0601561

(51) Int. Cl.
*A45B 9/02* (2006.01)
*A63C 11/22* (2006.01)

(52) U.S. Cl. ..... 135/65; 135/72; 135/76; 280/821

(58) Field of Classification Search ..... 135/65, 135/67, 72, 76; 280/817, 819, 821–823
See application file for complete search history.

(56) References Cited

U.S. PATENT DOCUMENTS

| | | | | | |
|---|---|---|---|---|---|
| 3,436,090 | A * | 4/1969 | Hebron et al. | 280/821 |
| 4,009,496 | A * | 3/1977 | Allen, III | 623/65 |
| 4,234,202 | A * | 11/1980 | Loffelholz | 280/820 |
| 4,641,857 | A * | 2/1987 | Gailiunas | 280/821 |
| 4,730,632 | A * | 3/1988 | Mace | 135/76 |
| 4,958,650 | A * | 9/1990 | Dale | 135/65 |
| 5,287,870 | A * | 2/1994 | Rhodes | 135/72 |
| 5,482,072 | A * | 1/1996 | Cimino | 135/72 |
| 6,170,500 | B1 * | 1/2001 | Turechek | 135/66 |
| 7,360,547 | B2 * | 4/2008 | Carlson | 135/66 |
| 7,445,016 | B1 * | 11/2008 | Ortiz | 135/65 |
| 2003/0227167 | A1 * | 12/2003 | Redor et al. | 280/819 |
| 2007/0120352 | A1 * | 5/2007 | Panizza | 280/819 |

FOREIGN PATENT DOCUMENTS

| | | | |
|---|---|---|---|
| DE | 19846785 | A1 * | 4/2000 |
| EP | 0 081 439 | | 6/1983 |
| FR | 2641169 | A1 * | 7/1990 |
| GB | 2110081 | A * | 6/1983 |
| JP | 11319183 | A * | 11/1999 |
| WO | WO 9726053 | A1 * | 7/1997 |

OTHER PUBLICATIONS

Written Opinion of the International Searching Authority for PCT/SE2007/000657, mailed Oct. 25, 2007.

* cited by examiner

*Primary Examiner*—Winnie Yip
(74) *Attorney, Agent, or Firm*—Nixon & Vanderhye PC

(57) ABSTRACT

This invention refers to a stick (1) intended for use by a person moving in a forward direction on a surface, comprising an elongated stick shaft (2) and a handle component (12). The handle component is angled in relation to the stick shaft (2). The invention also refers to a handle component.

22 Claims, 4 Drawing Sheets

STICK AND HANDLE COMPONENT

This application is the U.S. national phase of International Application No. PCT/SE2007/000657, filed 4 Jul. 2007, which designated the U.S. and claims priority to Sweden Application No. 0601561-4, filed 13 Jul. 2006, the entire contents of each of which are hereby incorporated by reference.

This invention refers to a stick or pole intended for use by a person moving in a forward direction on a surface, such as in skiing of different kinds, roller skiing or roller-skating, ice-skating of different kinds, in-line skating, walking and the like. The invention also comprises a handle component.

All the subsequent descriptions of previously known technology and of the invention are based on the assumption that the stick/handle component herein described is regarded in a vertically standing position, where the central axis of the stick shaft, an axis which coincides with the direction of action of the stick, is mainly in a vertical position.

Movement activities in this type of transportation start with the usual movement patterns which are natural for a human being when moving forward, corresponding to that which takes place in walking, running and so on. Movement forward on a surface includes the use of aids such as various shoes, devices or aids which are arranged for the feet and it is also common to use sticks. The surface may be natural or artificial. The surface may be equipped with a natural or artificial covering of e.g. snow, ice or a snow-like or ice-like covering or the like. These may include roads, paths, forest tracks, ski tracks, ski slopes and all other imaginable surfaces and appliances, on which the movement of a person can be made easier through the use of sticks.

The sticks are used to introduce a driving force in order thereby to promote the forward movement, and to increase the speed of movement. The movement pattern when moving forward involves primarily leg and arm movements, but balancing activities also take place in the whole body. Both the leg and arm movements are essentially pendulum movements. The work with sticks is the same or similar for the different modes of forward movement.

Traditional sticks usually have an elongated stick shaft. The stick shaft has two ends. One end is directed downwards towards the surface when the stick is used, and it has a spike at the extreme end. If the stick is used for movement on snow, the stick is usually fitted with some kind of disc at a distance up on the shaft of the stick which prevents the stick from sinking down into the snow. At the other end, there is a handle which is fitted around the upwards directed end of the stick and is equipped with a hand strap which is placed as a loop, fastened to the upper part of the handle. The development of sticks has taken place with respect to the choice of material and the design/construction of the stick shaft, of the stick discs and of the handles. The handles have become increasingly anatomically designed and some lack a hand strap, being instead equipped with rings or almost glove-like hand-retaining constructions of various kinds which fit around the hand.

The handle is fitted around the stick shaft or as an elongation of the stick shaft in the longitudinal direction of the stick in the upwards direction. Initially, the user of the stick holds the stick in such a way that the hand grips around the handle and so that the thumb and index finger clasp the handle, placed at the upper/outer part of the handle. With the help of the hand-retaining construction, the user's hand is fastened to the handle in such a way that the hand can let go of its grip around the handle but still remain connected with the handle/stick.

In an initial pushing stage, the stick is placed obliquely backwards in the surface, at a slightly pointed angle down towards the surface. The skier's arm and hand which hold the stick are directed forwards and are at a distance in front of the user. The hand is angled forwards, with the thumb upward and forward, and it follows the handle in the whole grip.

Thereafter, there follows a pulling stage. The user lowers the upper body forwards/downwards and pulls/pushes himself/herself forwards. The arm which holds the stick is activated and, when the user's body moves forwards, it executes a pendulum movement downwards/backwards.

When the hand has passed the nearest leg, a pushing stage begins. The user pushes himself/herself from the stick, which is in contact with the surface.

The movement of the arm continues backwards. The hand retains its contact with the stick via the hand-retaining construction.

To return to the initial stage, the user stretches the body so that the arm swings forwards, back to the beginning of the movement. In this forward movement, the user again grips the stick with the hand, which usually takes place through a pulling/throwing movement in the wrist/arm which throws/pulls the stick forward via the hand-retaining construction.

This stick movement, comprising an initial stage, a pulling stage, a pushing stage and a return stage, is carried out with the greatest precision and refinement in the pure double-stick or double-pole technique, but the movement pattern is in essence the same in various forms of diagonal skiing/skating where the legs also carry out swinging movements. In the double-stick technique, the same pattern of work takes place with both sticks at the same time, whereas in diagonal skiing, this takes place alternately with the right-hand and left-hand stick. The work of the arms with the sticks shall result in increased power to move the body forward. The movement of the stick and the work of the arm are more or less intensive and extensive in different fields of application, but they build on the same fundamental principles; that the user shall use the stick to provide support against the surface and to add extra energy for his/her movement forward through the use of the musculature of the upper body.

Due to the traditional construction of the stick, the body in a traditional stick movement does not utilise the musculature of the body optimally. The natural and strongest movement of the arm and hand cannot be carried out owing to the construction of the stick. The previously known sticks and the design of the handles mean that the arm is directed forwards and almost fully extended, and that the hand is angled forwards in the direction of movement in the initial stage and thereby also in the starting position for the pulling stage. The musculature in the arms is then extended and in its weakest position. In addition, the forward-directed position of the hand, to be able to hold the stick handle when the stick is directed forwards, leads to an additional weakening of the musculature in the arm/hand.

The object of this invention is to offer a stick and a handle component which make it possible to use the muscular force of the arm better in the forward-directed movement on a surface, e.g. in skiing of different kinds, roller-skiing and roller-skating, walking and the like.

This object is achieved with a stick with the characteristics indicated in patent claim 1 and with a handle component with the characteristics indicated in patent claim 20.

The invention and additional forms of execution, detailed designs and advantages are described in the following text with references to the accompanying figures.

Figure 4:
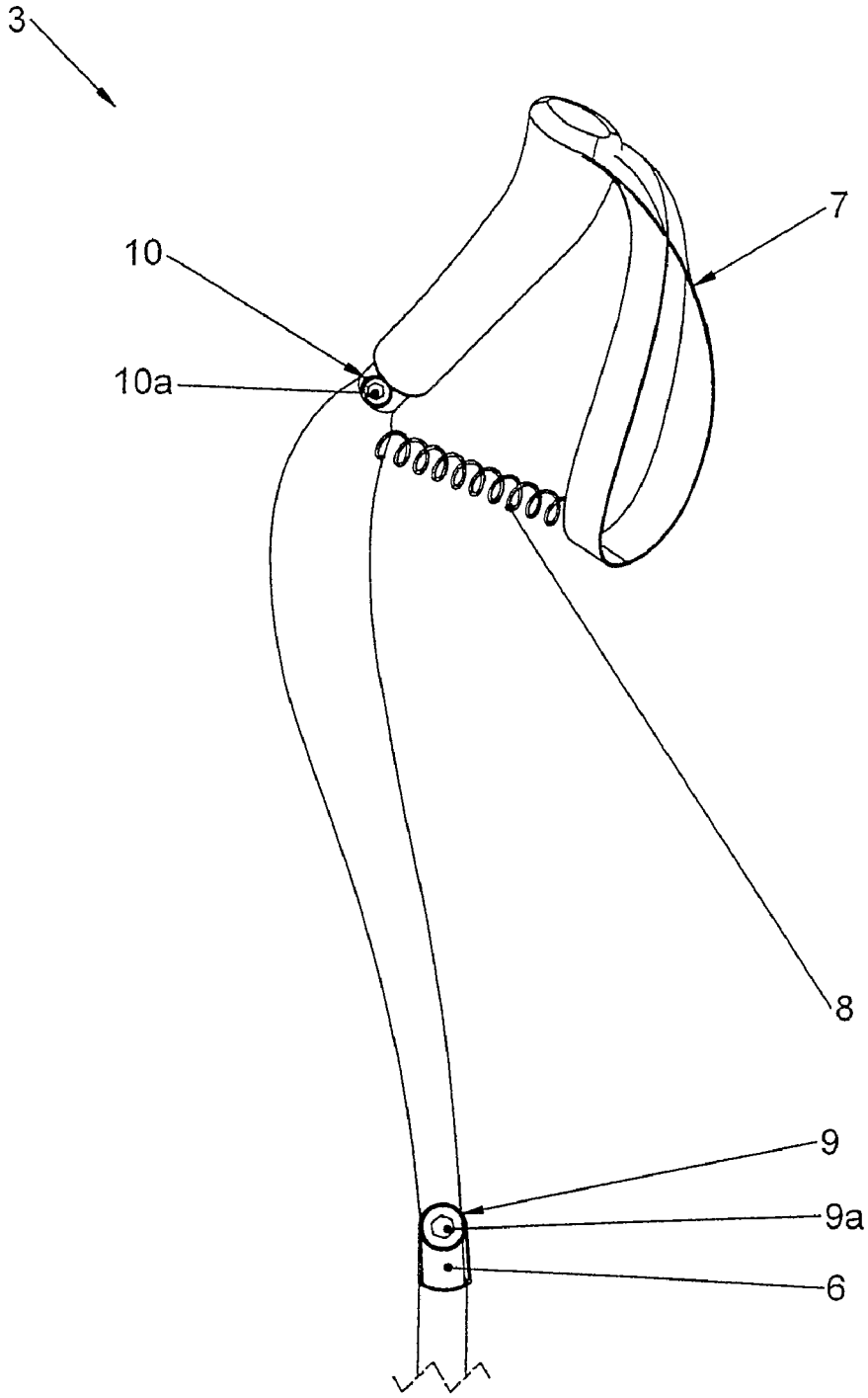

FIG. 4 also shows a handle component in accordance with the invention.

The basic features of the invention are described in the following analysis:

In the initial stage of work with a stick, it is an advantage if the arm does not need to be completely outstretched when the stick makes contact with the ground, since the arm muscles are then at their weakest position. The force of the arm is greatest if the hand can be placed in a manner which corresponds to the placing of the hand in relation to the arm during a normal unloaded pendulum movement with the arm. It is also an advantage if it possible for the arm to work in the longitudinal direction of the stick, downwards/backwards at the beginning of the pulling movement so that the contact between the stick and the surface becomes forceful and distinct.

In addition, if the arm can be angled at the initial stage, a longer stick can be used. A longer stick contributes to a longer distance of movement for each stroke with the stick.

In the pulling position, the arm is strongest if a line drawn across the palm in the bending/gripping region of the hand is mainly at a right angle to the central axis of the lower arm, so that the hand and arm can work with straight movements. The muscles of the arm can then be used in the best and strongest manner. The central axis of the lower arm should be as parallel as possible with the central axis of the stick and preferably coincide with the same.

The central axis of the stick refers to an imaginary axis which coincides with the direction of action of the stick. Usually, the stick is straight and the central axis of the stick is centred in the stick, follows its natural longitudinal axis, and coincides with an axis which corresponds to the direction in which the stick is acting. The intention is that the stick shall be placed against the ground, that the person shall receive support for movement in a forward direction, and that the person shall be able to push himself/herself forward against the surface.

If the stick is changed in shape in its longitudinal direction, e.g. bent in some way, the stick still works in one direction and a central axis can be said to refer to the direction in which the force works in the stick, and also the direction in which the force and thus the stick will act against the surface.

It is difficult to attain a situation in which the central axis in the lower arm is parallel with and coincides with the central axis of the stick, since it would then in principle be desirable that the arm and stick shaft were in the same place at the same time. Nor may the stability and balance in the stick be neglected. A satisfactory result is attained if the hand can be held more or less at right angles with the central axis in the lower arm and if a central point in the hand can lie on, or mainly on, an imagined elongation of the central axis of the stick, the axis which coincides with the direction of action of the stick. The pulling force of the arm will then work in the direction of action of the stick, in the longitudinal direction of the stick.

Optimum work is done if the central point in the hand lies on the axis which coincides with the direction of action of the stick, the central axis of the stick. Deviations from this, within certain margins, are of course acceptable. The tolerances for deviations from this depend e.g. on the person who uses the stick, on the material chosen for the stick and the different parts of the stick, on the way in which the stick is used and on the field of application concerned. The tolerance for how far the central point is placed from the axis which coincides with the direction of action of the stick should be considered so that disturbing bending forces do not arise in the stick at the time of contact with the ground, due to the moment which can arise if the hand is placed too far from the central axis of the stick.

It is also important for the energy utilisation that the arm works as close as possible to the body during the whole work with the stick.

Figure 1:
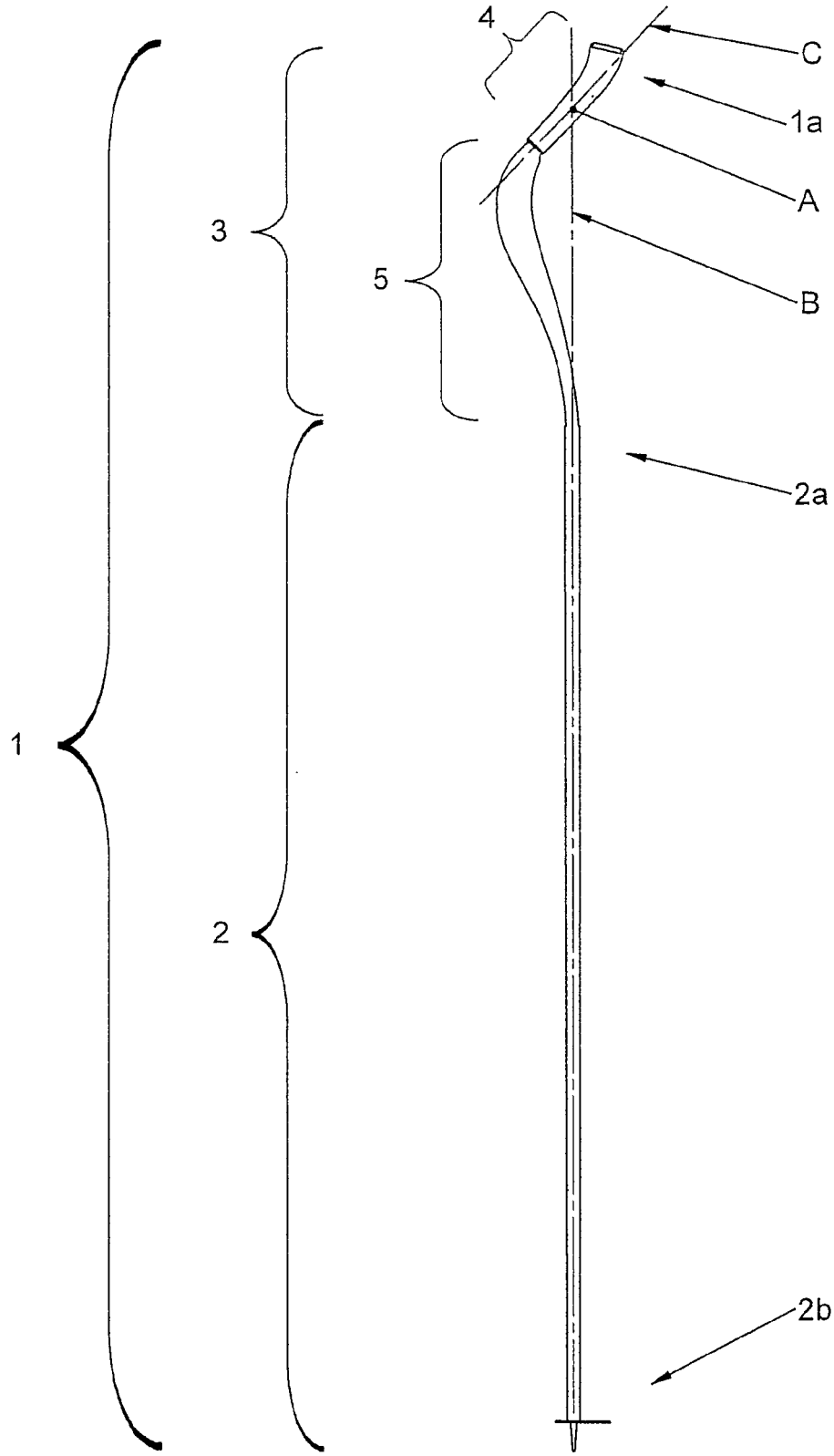
FIG. 1 shows a stick in accordance with the invention.
Figure 2:
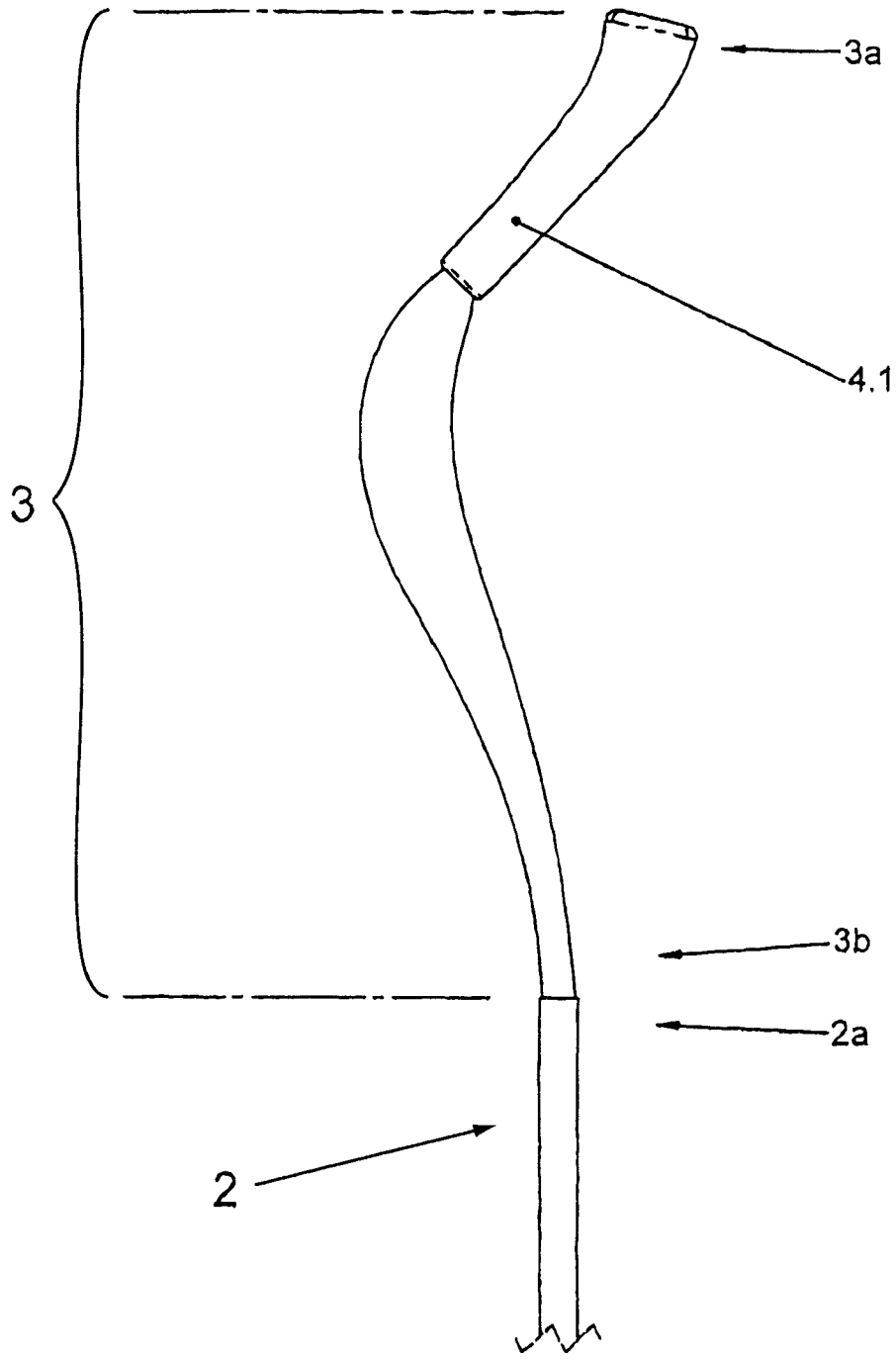
FIG. 2 shows a stick with a detached handle component in accordance with the invention.

DESCRIPTION OF THE INVENTION WITH REFERENCES TO THE FIGURES:

The invention refers to a stick 1 which consists of an elongated shaft, a stick shaft 2, and a handle component 3, see FIG. 1. The handle component 3 is connected with the stick shaft 2 at the upper end of the stick shaft 2*a*, or constitutes an upper part of the stick shaft 2, and defines the upper, proximal end 1*a* of the stick 1, which is also the upper end 3*a* of the handle component 3 (cf. FIGS. 1 and 2) and makes contact possible between the stick 1 and a user (not shown in the figures). At its other, lower, distal end 2*b*, the stick shaft has for example a spike and a disc or some other suitable construction for meeting the surface (only hinted at in the figures since this is not a part of the invention).

The handle component comprises, at its upper end 3*a*, a region in which the user's hand shall be arranged, a hand-grip region 4. The user's hand shall take hold of and hold around the hand-grip region 4 and hold the stick 1. The handgrip region 4 is elongated. The handgrip region 4 is suitably shaped so that it lies well in the hand. Both the design and properties of the hand-grip region can be changed and adapted according to different desires and priorities. The handle component 3 can in itself be shaped into a hand-adapted part 4.1 in the hand-grip region 4. The handle component 3 can also be fitted with a hand-adapted part 4.1, a hand grip, which is securely fixed to/round the handle component 3, in the hand-grip region 4, or which is detachable, exchangeable, assembled on/around the handle component 3, in the hand-grip region 4.

The handle component 3 also comprises a spacer part 5 fitted between the hand-grip region 4 and the stick shaft 2. The spacer part 5 is angled in relation to the stick shaft 2 and the handgrip region 4. The hand-grip region 4 is in turn angled in relation to the spacer part 5 and in relation to the stick shaft 2.

The spacer part 5 and the hand-grip region 4 are angled in relation to each other and to the stick shaft 2 in such a way that the handle component 3 is angled in relation to the stick shaft 2 and placed in relation to the stick shaft 2 so that a central point A in the hand which grips the handle component 2 lies primarily on a central axis B through the stick shaft 2. According to the previous reasoning concerning the central axis of the stick, it can also be said that the handle component 3 is placed in relation to the stick shaft 2 so that a central point A in the hand which grips the handle component 2 lies primarily on an axis B which coincides with the direction of action of the stick.

The central point A lies on a line C across the palm of the hand, in the bending region/gripping region of the hand.

The handle component 3, the spacer part 5, is angled forwards, in the direction of movement, in relation to the stick shaft 2, to provide space for the users hand and lower arm. As illustrated, e.g., in FIG. 1, the spacer part 5 is angled forwards at an angle of less than 90 degrees with respect to the central axis of the stick shaft 2. The hand-grip region 4 is angled backwards towards the skier in relation to the spacer part 5 and also in relation to the stick shaft 2. As illustrated, e.g., in FIG. 1, the hand-grip region 4 is inclined at an angle of less than 90 degrees with respect to the central axis of the stick shaft 2. This placing of the hand-grip region 4 makes it possible for the user to grip the stick 1 obliquely from below. Also the central point A of the hand-grip; the central point A in the hand will be placed mainly on the central axis B through the stick shaft 2, mainly on an axis B which coincides with the direction of action of the stick. The user has the stick 1 in front of himself/herself and in front of his/her lower arm when he/she holds the stick 1 at the initial stage in front of himself/herself.

The stick 1, the handle component 3, comprises a hand-retaining construction 7 which is not described in greater detail, since this is freely optional depending on the user's requirements and wishes. The hand-retaining construction 7 is suitably fastened at the upper part of the stick 1*a*, i.e., the upper end 3*a* of the handle component, so that it shall be possible to let go of the handle component 3 in the previously known manner. The hand-retaining construction 7 is shown symbolically in FIGS. 3 and 4. Other fixed points are of course possible as long as the purpose is achieved.

Figure 3:
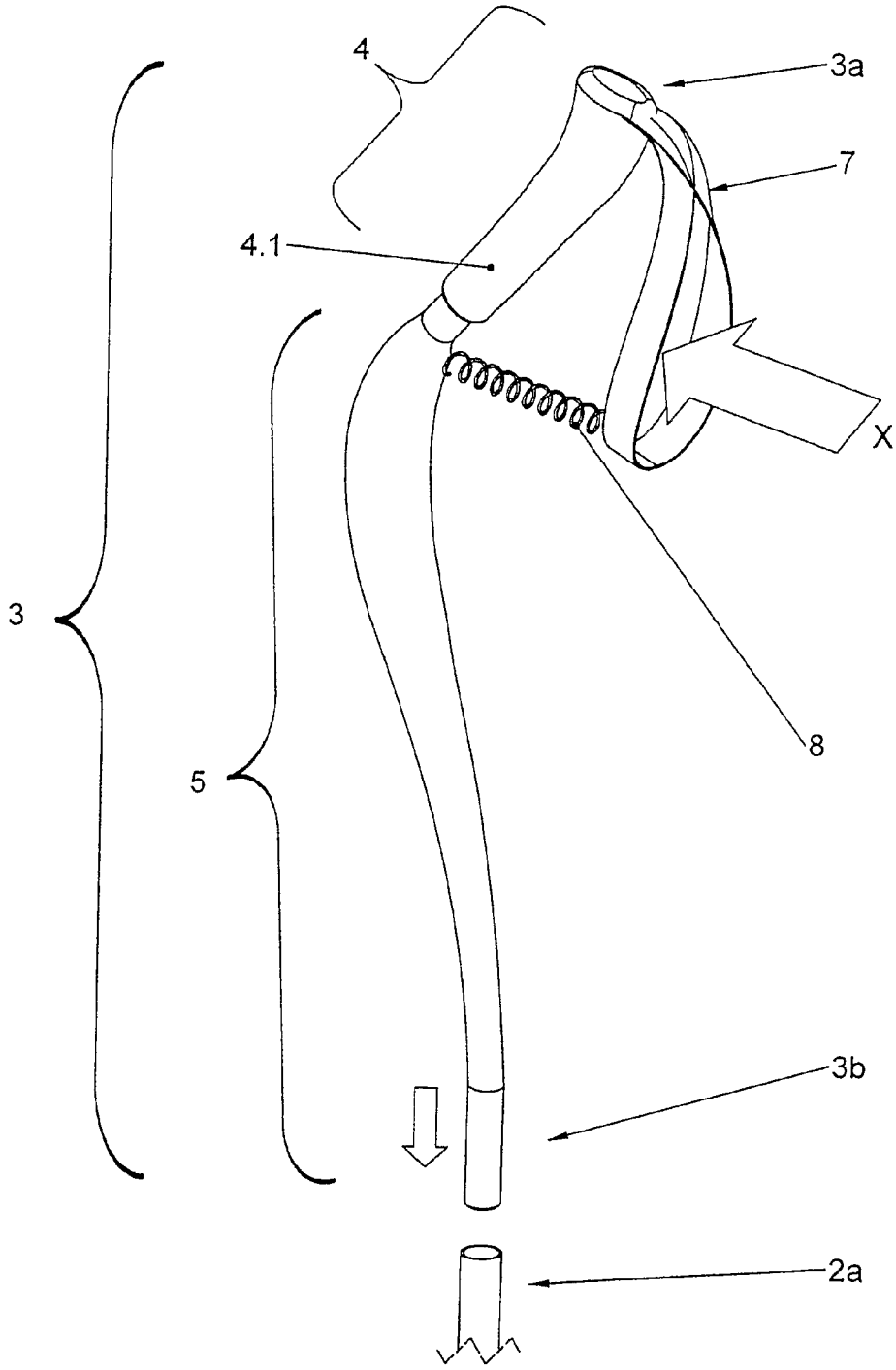
FIG. 3 shows a handle component in accordance with the invention.

The stick 1, the handle component 3, comprises a device 8 which returns the hand to the hand-grip region 4, see FIGS. 3 and 4. To hold the stick through active muscular work at all stages of the work with the stick is tiring and can lead to muscular cramp. In addition, it is impossible then to use the stick to the maximum effect, since it is difficult to keep the hand on the stick 1 farther back than to a position where the handle component 3 passes the hip. The returning/recovery device 8 allows the hand to move away from the handle component 3 which in this movement stores energy which is released and has a withdrawing action of the hand-holding construction 7 as previously described towards the stick (1) when the stick is no longer loaded with a force. This recovery device 8 makes it possible for the user to let go of the grip around the handle component 3 in order to rest the hand, to push with the hand against the hand-retaining construction 7, or for some other reason, to thereafter rapidly get the hand again in the correct position and to be able again to take hold of the handle component 3, the handgrip region 4. The recovery device 8 can be a spring construction, suitably detachable, arranged between the handle component 3 and the hand-retaining construction 7, see FIGS. 3 and 4.

The stick 1, the handle component 3, comprises an angling device 9 which makes it possible to determine, influence, adjust and set the angle between the stick shaft 2 and the handle component 3/the spacer part 5, see FIG. 4. The stick 1, the handle component 3 comprises an angling device 10 which makes it possible to determine, influence, adjust and set the angle between the spacer part 5 and the handgrip region 4, see FIG. 4. Each angling device 9 or 10 comprises a locking device 9*a* or 10*a* which makes it possible to lock the angling device 9 or 10 in a fixed chosen position.

The handle component 3 and the stick shaft 2 can be designed in one piece as a whole and uniform stick, see FIG. 1. The handle component 3 can also constitute a detached component which is connected to the stick shaft 2, see FIG. 2.

If the handle component 3 is a detached component, it shall be connected with the stick shaft 2 in order to create a stick 1, intended to be used by a person moving in a forward direction, usually on a surface of snow and/or ice but also in other types of movement, e.g. walking, see FIGS. 3 and 4.

The handle component 3 is connected with the stick shaft 2 in that its lower end 3*b*, the end directed towards the stick shaft 2, is designed to be connected to the stick shaft 2. This design can be of the type where the lower end of the handle component has a smaller diameter than the upper end 2*a* of the stick shaft, so that the lower end of the handle component 3*b* can be inserted into the upper end of the stick shaft 2*a*, or the opposite, see FIG. 3. This construction can include interacting furrows and notches in addition to stopping devices or locking devices. The handle component 3 can also include a device or a part of a device 6, arranged at the lower end of the handle component 3*b*, which makes it possible to connect the handle component 3 with the stick shaft 2, either directly with the stick shaft 2 or via the device 6, see FIG. 4. The connection can be permanent or detachable.

After being connected with the stick shaft 2, the handle component 3 is angled in relation to the stick shaft 2 and placed in relation to the stick shaft 2 so that a central point A in the hand which grips the handle component 3, the hand-grip region 4, lies primarily on a central axis B through the stick shaft 2, primarily on an axis B which coincides with the direction of action of the stick. The angling device 9 between the stick shaft 2 and the handle component 3 constitutes a part of the connection device 6 or is a detached separate unit. Otherwise, the handle component 3 has the same construction and function as the previously described handle component 3 which constitutes a part of stick 1.

To take hold of a stick 1 in accordance with the invention, see FIG. 1, an imaginary user comes with his/her hand into the figure from the right and brings his/her hand obliquely from below towards the device, see the direction arrow X in FIG. 3, and thereafter grabs hold of the handle component 3, in the hand-grip region 4. The wrist and arm are below the hand-grip region 4. The hand is arranged in the hand-retaining construction 7 and the recovery device 8 is assembled. One or several of the angling devices 9 and/or 10 have been adjusted and locked in the desired position. Thereafter, the work with the stick is started.

At the initial stage of the work with the stick when the stick is used in accordance with the invention, the arm does not need to be completely outstretched when the stick makes contact with the ground surface. The position of the hand in relation to the arm can be kept as straight as possible, and a line across the palm, at the bending area/gripping area of the hand, is in the main at a right angle to the central axis in the lower arm. The hand is placed in a way which, throughout the work with the stick, corresponds to the placing of the hand in relation to the arm in the case of a normal unloaded pendulum movement of the arm. It is possible for the arm to work in the main in the longitudinal direction of the stick, the direction of action, downwards/backwards at the beginning of the pulling movement so that the contact between the stick and the surface is forceful and distinct.

The arm is slightly angled at the initial stage and a longer stick can therefore be used, and a longer stick contributes to a longer distance of movement for each push with the stick.

In the pulling position, the arm is strong since the central point of the hand, in the bending area/gripping area of the hand, is mainly in the central axis of the stick, mainly on an axis which coincides with the direction of action of the stick. The tensile force then achieved is greater than in the use of an ordinary stick, since the muscles of the arm can work effectively in the pulling position, and the force which arises works with a pushing away action in the longitudinal direction of the stick, the direction of action.

In the whole work with the stick, the arm can be held and allowed to work close to the body thanks to the body-following design of the stick, which gives an effective energy utilisation.

When the user puts the stick down against the surface and starts the pulling work, the hand grip is angled so that the pulling force will act mainly in the longitudinal direction of the stick, the direction of action. The more angled the stick is in relation to the surface, the straighter will be the direction of the tensile force and the greater the force for moving the user forwards.

The continued handling of the stick conforms to the previously known procedure, depending on the field of application.

The constructions and designs mentioned in the description of the invention can be freely combined to give the best imaginable stick/handle component for the purpose.

This description of the invention shall not be seen as a limitation, but shall be used as a guideline for a full understanding of the invention. Adaptations of various components in relation to other active components, choice of material, size adaptation, shape adjustment, replacement of components and details and anything else which is self-evident or lies close at hand for a skilled person within this sphere of technology can of course be carried out within the scope of the invention.

The invention claimed is:

1. Stick for use by a person moving in a forward direction on a surface, the stick having a lower, distal end and an upper, proximal end, and comprising:

an elongated stick shaft extending generally linearly from said distal end along a central, longitudinal axis toward said proximal end, said stick shaft terminating at a point distal of said proximal end; and a handle component extending from said stick shaft to said proximal end, wherein said handle component includes a spacer portion extending from said stick shaft, said spacer portion being inclined away from said central axis in said forward direction, said spacer part being inclined in said forward direction at an angle of less than 90 degrees from said central axis, said handle component further includes a hand-grip portion extending from said spacer portion to said proximal end, said hand-grip portion being inclined in a rearward direction, opposite to said forward direction, at an angle of less than 90 degrees with respect to said central, longitudinal axis, the hand-grip portion includes a hand-grip part adapted to be grasped by a hand of the person, a central point of said hand-grip part being disposed mainly on said central, longitudinal axis of the stick shaft, whereby when the person grasps the hand-grip part at an initial stage of motion, the person has the stick in front of himself and in front of his lower arm.

2. Stick in accordance with claim 1, wherein the handle component is shaped to define the hand-grip part.

3. Stick in accordance with claim 1, wherein the hand-grip part is firmly arranged on and around the handle component.

4. Stick in accordance with claim 1, wherein the hand-grip part is detachable, replaceable, and arranged on and around the handle component.

5. Stick in accordance with claim 1, further comprising a hand-retaining construction fixed at an upper end of the hand-grip portion of the handle component.

6. Stick in accordance with claim 5, further comprising a device which permits movement of the hand away from the handle component and which in this movement stores energy which is released and has a withdrawing action on the hand-retaining construction towards the handle component when the handle component is no longer loaded with a force.

7. Stick in accordance with claim 1, further comprising an angling device which makes it possible to determine and lock the angle between the stick shaft and the handle component.

8. Stick in accordance with claim 1 further comprising an angling device which makes it possible to determine and lock the angle between the hand-grip portion and the spacer portion.

9. Stick in accordance with claim 1, wherein the handle component and the stick shaft are formed as a single, integrated piece.

10. Stick in accordance with claim 1, wherein the handle component is formed separately from the stick shaft and is detachably connected with the stick shaft.

11. Stick in accordance with claim 10, wherein the handle component is configured at a lower part thereof to be connected with the stick shaft.

12. Stick in accordance with claim 10, further comprising a connection device which makes it possible to connect the handle component and the stick shaft, and which is arranged between the handle component and the stick shaft.

13. Handle component adapted for connection to a stick shaft to form a stick for use by a person moving in a forward direction on a surface, the handle component comprising:

a spacer portion adapted to extend from said stick shaft, after connection of the handle component with the stick shaft, in angled in relation to a central axis of the stick shaft, said spacer portion being inclined in said forward direction at an angle of less than 90 degrees from said central axis, and a hand-grip portion extending from said spacer portion, said hand-grip portion being inclined in a rearward direction, opposite to said forward direction, at an angle of less than 90 degrees with respect to said central axis of the stick shaft, the hand-grip portion including a hand-grip part adapted to be grasped by a hand of the person, a central point of said hand-grip part being disposed mainly on said central axis of the stick shaft, whereby that the user of the stick grips the handle component at an angle from below and the handle component is placed in relation to the stick shaft so that a central point in the hand which grips the handle component lies mainly on an axis which coincides with the direction of action of the stick.

14. Handle component in accordance with claim 13, wherein the handle component is configured at a lower part thereof to be connected with the stick shaft.

15. Handle component in accordance with claim 13, further comprising a device or a part of a device which makes it possible to connect the handle component with the stick shaft.

16. Handle component in accordance with claim 13, wherein the handle component is shaped to define the hand-grip part.

17. Handle component in accordance with claim 13, wherein the hand-grip part is fixed on and around the handle component.

18. Handle component in accordance with claim l3, wherein the hand-grip part is detachable, exchangeable, and fixed on and around the handle component.

19. Handle component in accordance with claim 13, further comprising a hand-retaining device fixed to the upper part of the handle component.

20. Handle component in accordance with claim 19, further comprising a device which allows the hand to let go of the handle component and which in this movement stores energy which is released and acts to withdraw the hand-retaining device towards the handle component when the handle component is no longer under load.

21. Handle component in accordance with claim 13, further comprising an angling device which makes it possible to determine and lock the angle between the stick shaft and the handle component.

22. Handle component in accordance with claim 13, further comprising an angling device which makes it possible to determine and lock the angle between the hand-grip portion and the spacer portion.

* * * * *